United States Patent [19]

Marin A.

[11] Patent Number: 4,620,515

[45] Date of Patent: Nov. 4, 1986

[54] ROTARY FLUID-HANDLING MECHANISM CONSTRUCTED AS AN INTERNAL COMBUSTION ENGINE

[76] Inventor: Alvaro Marin A., Juan Palau 1845, Santiago, Chile

[21] Appl. No.: 680,935

[22] Filed: Dec. 12, 1984

Related U.S. Application Data

[63] Continuation-in-part of Ser. No. 628,406, Jul. 6, 1984.

[51] Int. Cl.[4] ..... F02B 53/00

[52] U.S. Cl. ..... 123/233; 123/229; 418/226

[58] Field of Search ..... 123/221, 229, 231, 233; 418/175, 195, 225, 226, 227

[56] References Cited

U.S. PATENT DOCUMENTS

| | | | |
|---|---|---|---|
| 2,141,982 | 12/1938 | Good | 418/226 X |
| 2,154,328 | 4/1939 | Good | 418/226 X |
| 2,243,005 | 5/1941 | Good | 418/226 X |
| 2,250,368 | 7/1941 | Good | 418/226 X |
| 2,500,143 | 3/1950 | Biermann | 418/195 |
| 3,477,414 | 11/1969 | Marin | 123/233 |
| 3,739,754 | 6/1973 | Nutku | 123/229 |

*Primary Examiner*—Michael Koczo
*Attorney, Agent, or Firm*—Mallinckrodt & Mallinckrodt

[57] ABSTRACT

A rotary mechanism for handling fluids constructed as an internal combustion engine (diesel or otherwise), has a rotor internally cylindrically recessed from one end to receive, in close fitting, sealing relationship, a stationary cylindrical support for a plurality, usually a pair, of rotary blades. The rotor is provided internally with a corresponding plurality of cavities helically oriented to receive portions of the respective blades which enter and pass through the respective cavities for compressing or propelling the particular fluid concerned. Inflow and outflow ports for the fluid are variously arranged in either the stationary cylindrical blade support or the rotor or both depending again upon the particular nature of the mechanism. Various arrangements are provided for maintaining blade and rotor rotation in synchronism. The mechanism may be used in various ways in conjunction with other mechanisms. Thus, for example, it may be incorporated in an electric motor or generator, in an airplane to provide propulsion by propellers or jet, and in a stationary power source.

16 Claims, 28 Drawing Figures

ROTARY FLUID-HANDLING MECHANISM CONSTRUCTED AS AN INTERNAL COMBUSTION ENGINE

RELATED APPLICATION

The present application is a continuation-in-part of my similarly entitled, copending application Ser. No. 628,406, filed July 6, 1984, and discloses additional embodiments presently contemplated as the best mode of carrying out the invention in practice.

BACKGROUND OF THE INVENTION

1. Field:

The invention is concerned with rotary mechanisms, such as air compressors and pumps, and air or hydraulic motors, that are operated by fluids, but particularly with internal combusion engines.

2. State of the Art:

In my U.S. Pat. No. 3,477,414 granted Nov. 11, 1969, entitled "Rotary Fluid-Handling Mechanism", I disclosed mechanism of the type concerned wherein a pair of rotary blades, at opposite sides of a central rotor that is provided with respective cavities through which extremities of the blades pass, serve to progressively change the volumes of cavity portions at opposite faces of the blades for accomplishing the purpose of the particular mechanism concerned. Since that time, so-called "single screw" air compressors have been developed and marketed using the same principle, wherein a pair of circular blades in the form of rimless, multi-spoked wheels takes the place of the elongate blades shown in my patent and a helical screw-threaded rotor takes the place of the dual-cavity rotor shown in my patent, all as shown by trade literature of Chicago Pneumatic Tool Co. covering its "Single/Screw" air compressor.

SUMMARY OF THE INVENTION

The present invention constitutes an improvement on my patented mechanism and on the "single screw" mechanism, in that, now, the blades are located one above the other on respective parallel axes in a stationary cylindrical support internally of the rotor. The interior surface of the rotor is provided with cavities which receive extremities of the respective blades. The blades and rotor may otherwise correspond to those shown in my patent or to the so-called "single screw" type of air compressor mentioned above.

By such rearrangement, totally unexpected results are achieved in that the volume of fluid handled in any given time is much greater than otherwise, making for greater compactness and lightness of the mechanism per unit volume of fluid handled, which, in the case of an internal combustion engine, means unusual compactness and lightness per horsepower, and much greater torque is achieved. This mechanism combines the advantages of a piston type of engine (variable volume with those of a turbine (high speed rotary movement). Moreover, the mechanism can be integrated with electrical machinery in a way that results in further useful applications, and can be provided in the form of an artificial heart.

THE DRAWINGS

In the drawings:

FIG. 1 is a top plan view of an air compressor according to the invention as secured to a vertical support and extending in cantilever fashion therefrom;

FIG. 2, a front elevation of the air compressor of FIG. 1, looking from the line 2—2 of FIG. 1, the hidden cavities of the rotor, the blades, and shaft-interconnecting gearing being indicated by broken lines in the positions assumed on a compressing half cycle of operation;

FIG. 3, a horizontal section taken on the line 3—3 of FIG. 2, the sweep of the underlying blade being indicated by broken lines;

FIG. 4, a similar section drawn without blade drive mechanism, to show the relative positions of the blades on the succeeding quarter cycle of operation;

FIG. 5, a view corresponding to that of FIG. 4, but showing the relative positions of the blades at the end of that compressing cycle and the beginning of the next compressing cycle;

FIG. 6, a vertical section taken on the line 6—6 of FIGS. 2 and 3, with the cylindrical blade support removed to show cavity shape and corresponding blade position;

FIG. 7, a similar section showing the relative positions of the same rotor cavity and blade on the succeeding quarter cycle of operation, with the other rotor cavity just coming into view;

FIG. 8, a similar section showing the relative positions of the cavities of the rotor and both blades at the end of that compression cycle and the beginning of the next compression cycle, respectively;

FIG. 9, a side elevation of the mechanism looking from the left in FIG. 1, with the rotor removed to reveal the upper blade in its operating recess and interior ports of the air inflow and compressed air outflow passages, the passages themselves being indicated by broken lines;

FIG. 10, a view corresponding to that of FIG. 6, but showing an alternative arrangement of interior air-inflow port and of the passage (indicated by broken lines) extending through the rotor instead of through the cylindrical blade support, this being the arrangement employed if multiple spoke, rimless wheels and corresponding multiple cavities are employed instead of the elongate blades and the dual cavities of the foregoing figures;

FIG. 11, a view largely corresponding to that of FIG. 3, but illustrating an embodiment of internal combustion engine in accordance with the invention, the combustion chamber being indicated by broken lines;

FIG. 12, a view in side elevation corresponding to that of FIG. 9, but of the internal combustion engine embodiment of FIG. 11, the combustion chamber again being indicated by broken lines;

FIG. 13, a side elevational view similar to that of FIG. 12, but looking from the right in FIG. 1, rather than the left;

FIG. 14, a top plan view of a blade of the engine of FIGS. 11–13 equipped with sealing rings;

FIG. 15, a vertical section taken on the line 15—15 of FIG. 14;

FIG. 16, a view similar to that of FIG. 14, but showing an embodiment of elongate blade that provides synchronism without the need for gearing;

FIG. 17, a two dimensional layout of the inner cylindrical surface of a rotor adapted for use with the blades of FIG. 16, showing the rotor cavities;

FIG. 18, a view in axial horizontal section similar to that of FIG. 3, but illustrating a presently preferred embodiment of the invention in the form of an air compressor;

FIG. 19, a vertical section taken along the line 19—19 of FIG. 18;

FIG. 20, a schematic view in perspective of a sealing arrangement for use in a combustion engine having the blade arrangement of the compressor of FIGS. 18 and 19;

FIG. 21, a view similar to that of FIG. 4 but showing a presently preferred embodiment wherein the blades are circular for maximum volume of the respective compression chambers, the synchronizing mechanism being similar to that of FIGS. 18 and 19;

FIG. 22, a two dimensional layout similar to that of FIG. 17, but with respect to the embodiment of FIG. 21;

FIG. 23, a view similar to that of FIG. 11 showing the internal combustion engine there illustrated utilized as an airplane motor;

FIG. 24, a view corresponding to that of FIG. 23 but showing the air compressor of FIG. 21 (except that the synchronizing mechanism is similar to that of FIG. 1) incorporated in the construction of FIG. 23, with rotors of engine and air compressor joined for actuation in common, the combination motor and air compressor being useful as either a jet engine burner with expansion nozzle (not shown) or stationary compressor;

FIG. 25, a view similar to that of FIG. 24 but taken with respect to only the air-compressor portion of FIG. 24, utilized as the rotor portion of an electric motor which serves as the drive unit therefor;

FIG. 26, a view corresponding to that of FIG. 11 showing the mechanism as a motor incorporated in an electric generator as the drive unit therefor the synchronizing means being that shown in FIGS. 16 and 17;

FIG. 27, a view corresponding to that of FIG. 20 showing a sealing ring arrangement for the respective rotors of the embodiments of FIGS. 11, 23, 24, 25 and 26; and FIG. 28, an axial section taken through an artificial heart incorporating the invention as a pumping mechanism.

DETAILED DESCRIPTION OF ILLUSTRATED EMBODIMENTS

In the form of the mechanism illustrated in FIGS. 1–9, an air compressor is mounted in cantilever fashion by a vertical supporting structure of any suitable construction, indicated at 15, to hold it securely during operation. However, it could be mounted in various ways depending on the manner in which it is used.

Figure 2:
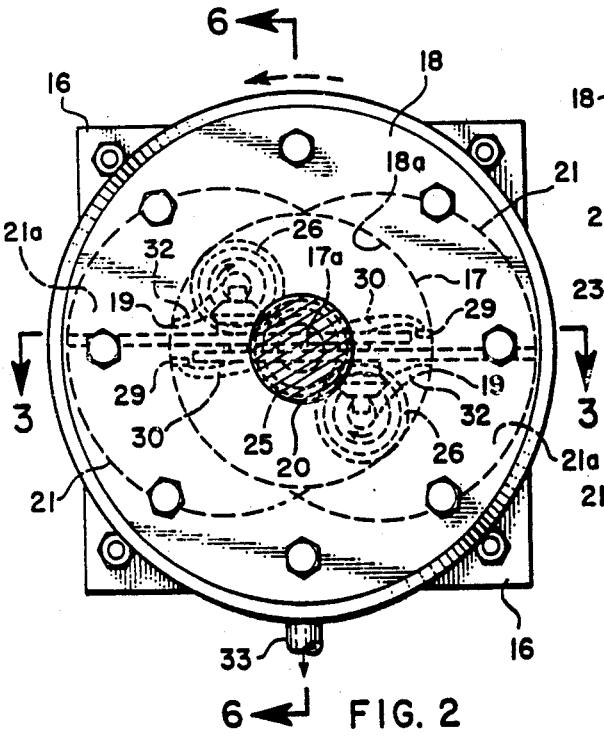
Figure 4:
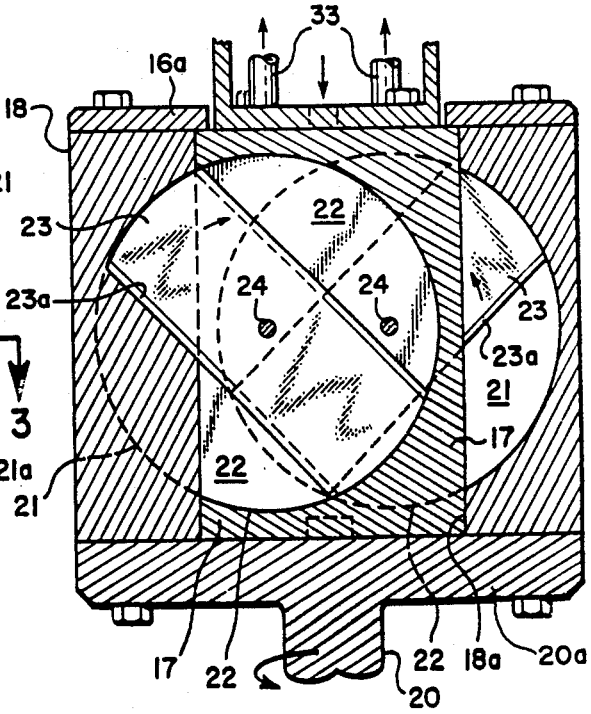
Figure 5:
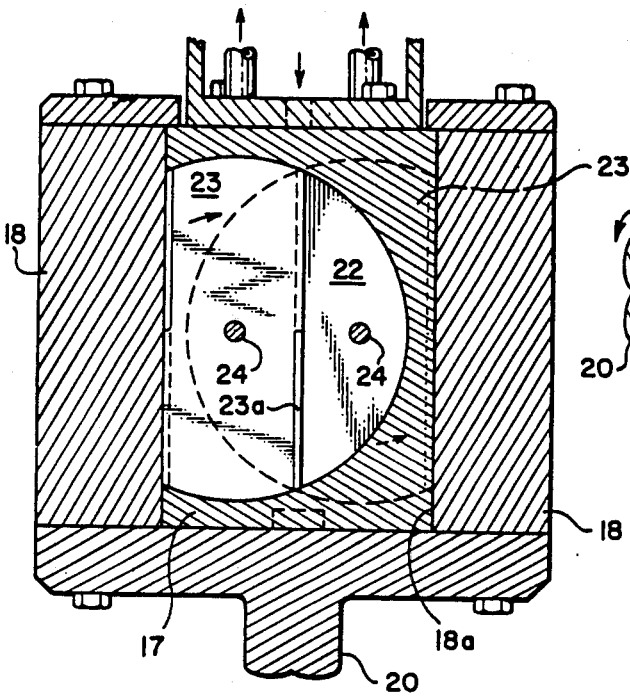
Figure 9:
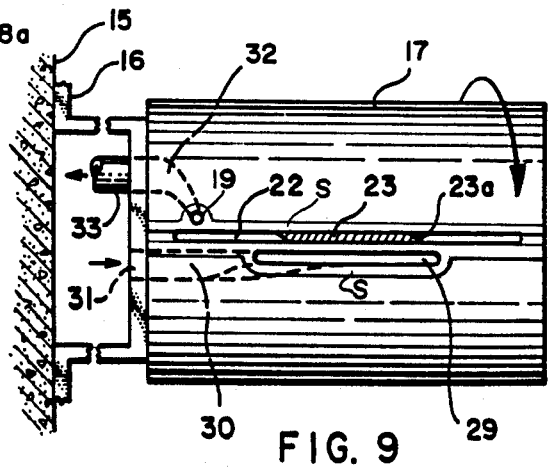

As shown, mounting brackets 16 extend from securement in any suitable manner to a stationary, cylindrical blade support 17, see especially FIGS. 2 and 9, which rotatably carries, in sealing relationship therewith, a rotor 18 internally recessed from one end thereof to receive the cylindrical blade support. A securement ring 16*a*, fastened to rotor 18 after installation of the rotor on blade support 17, holds the rotor on the support. The opposite end of rotor 18 is shown as being entirely closed by end plate 20*a*, but this is not a prerequisite.

Sealing is conveniently effected by mixing oil vapors with intake air in customary manner. However, if rotor 18 is driven at high speed (about twenty thousand RPM), such sealing may not be necessary. In the event more effective sealing is required in certain instances, longitudinal sealing strips, indicated at S, FIG. 9, performing the function of well known piston rings, may be provided over and along opposite sides of each compressed air outlet port 19 and inlet port 29, which extends therethrough.

Rotor 18 has a power input shaft 20 extending from fixed securement thereto at the end thereof opposite the aforesaid one end, as by means of removable closure plate 20*a*. Shaft 20 is coupled to motive means, such as an electric or other motor (not shown), in any suitable manner. Rotor 18 is provided internally with cavities, here shown as dual cavities 21, opening into its interior cylindrical surface 18*a* which is interfaeed with the cylindrical surface of blade support 17.

Blade support 17 is recessed internally to provide chambers 22 for respective blades 23, here a pair of same in keeping with the pair of cavities 21 provided by rotor 18. The chambers 22 are separated by a partition wall 17*a*, FIGS. 2 and 8. Blades 23 and their respective chambers lie one above the other, and the blades are rotatably mounted on respective stub shafts 24 for rotation relative to each other.

Figure 1:
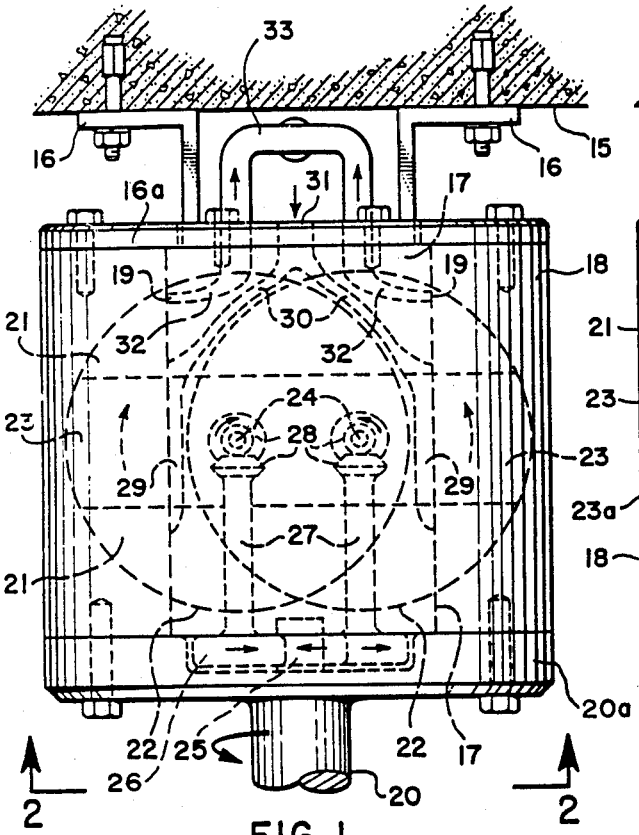
Figure 3:
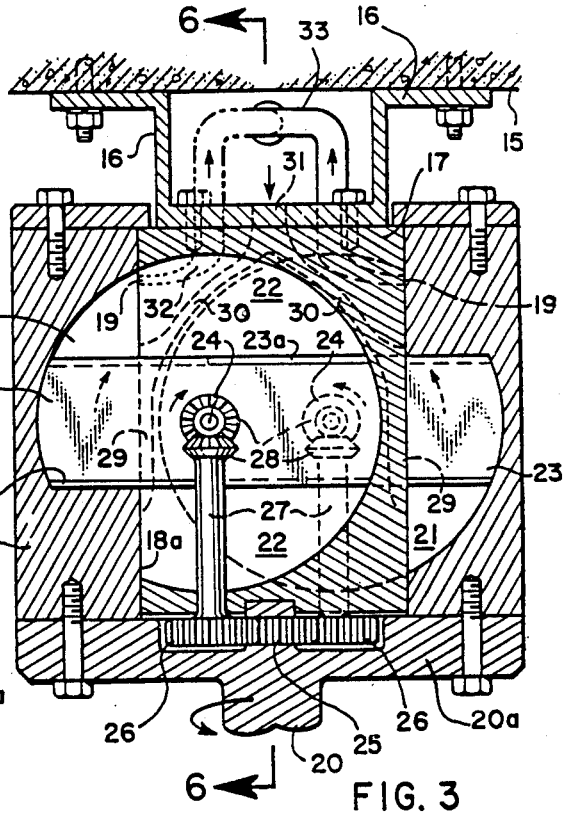

Rotation of the blades in synchronization and synchronized with rotation of the rotor is effected by geared interconnection with rotor 18, as by spur gear 25, FIGS. 1, 2 and 3, rigidly held on rotor 18 and meshing with planetary gears 26 on respective countershafts 27 which have bevel gear interconnections 28 with the respective blade stub shafts 24 (helical teeth on the several gears is preferred). Such gearing as synchronizing means for blades and rotor is unnecessary in "single screw" embodiments of the mechanism wherein the blades are rimless, multi-spoked wheels, since the resulting multiple sets of interengaging blades and rotor cavities themselves function as synchronizing means.

Blades 23 are of any desired elongate configuration and rotate oppositely in their respective chambers 22. Their terminal ends pass into and through the respective cavities 21, which, being helically oriented with respect to the axis of rotation of the rotor, means that the volumetric capacities of the cavity portions in advance of the moving blades are progressively reduced and the air within such cavity portions is progressively compressed. The longitudinal edges of the blades are on the bias, as at 23*a*, so as to match the helical orientation of the longitudinal walls of the respective cavities.

The terminal portions of the blades that contact the walls of the cavities are oil sealed as previously explained for low speed operation and require no sealing for high speed operation.

Figure 7:
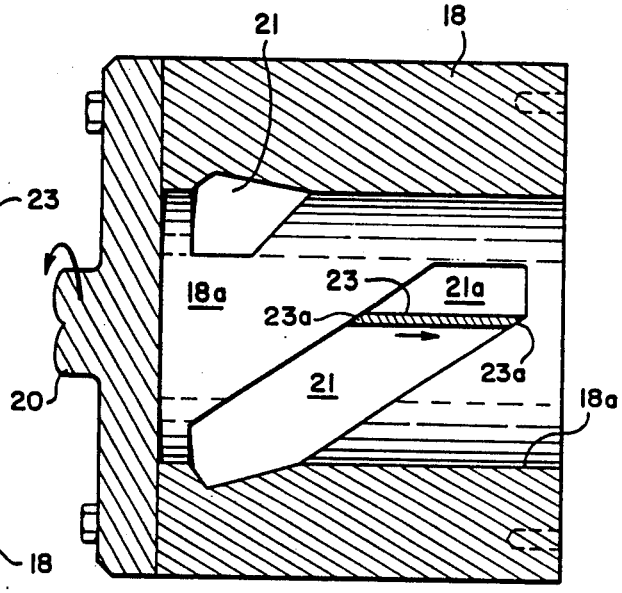
Figure 8:
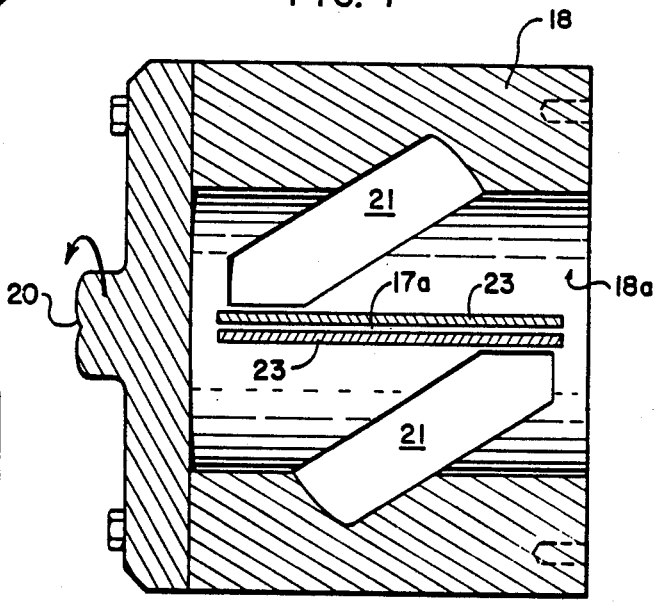
Figure 6:
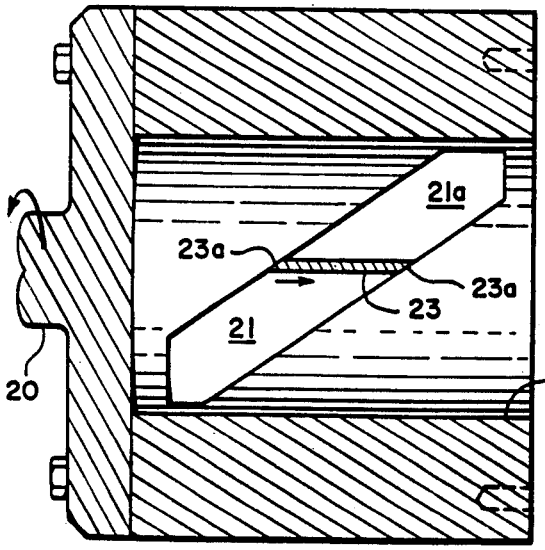

As illustrated, power input shaft 20 is rotated counterclockwise, thereby rotating rotor 18 counterclockwise and advancing blades 23 in the directions of the appended arrows, providing balanced air-compressing strokes in those directions and compression of air within the portions 21*a*, FIGS. 6 and 7, of lessening volumetric capacity, of respective rotor cavities 21.

Air inlet ports 29, FIGS. 2 and 9, at the cylindrical face of blade support 17 have respective passages 30 leading thereto from a port 31 at the outside-facing end of such blade support, through which atmospheric air is drawn into the compressor mechanism. The compressed air is discharged through smaller ports 19 into corresponding smaller passages 32 and through outlet ports and piping 33, FIG. 1, into a pressure tank (not shown) for use.

Continued rotation of blades 23 repeats compressive strokes of the mechanism each half cycle of the rotation.

Figure 10:
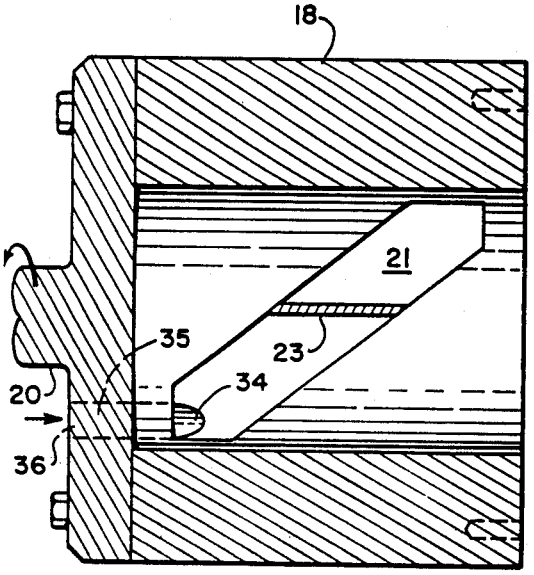

Air-inflow ports and passages may be located in the rotor as shown in FIG. 10, where for each cavity 21 an interior port 34 is served by a passage 35 leading from an outer port 36 that is open to the atmosphere. Such arrangement may be used if desired with the elongate-bladed embodiment illustrated, but is necessary for a multi-spoked, "single screw" type of arrangement previously referred to but not illustrated.

When constructed as an internal combustion engine, shown in FIGS. 11–15 mounted in the same way as the air compressor, a combustion chamber 37 is formed in the cylindrical blade support, here designated 38, and, except for diesel mode, a spark plug 39 is provided for igniting a fuel mixture compressed within such chamber. A fuel mixture is supplied from a suitable carburetor through an exterior intake part 40, FIG. 13, in the exposed end of cylindrical blade support 38, from where it flows through passage 41 leading to internal intake port 42. For diesel mode, the spark plug is replaced by the usual fuel injector and the size of the combustion chamber is appropriately reduced.

Figure 14:
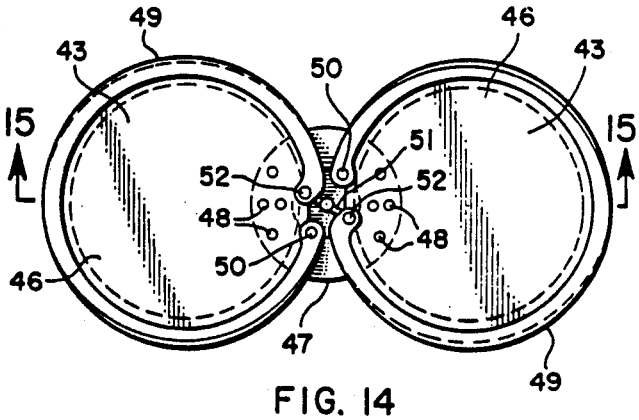
Figure 15:
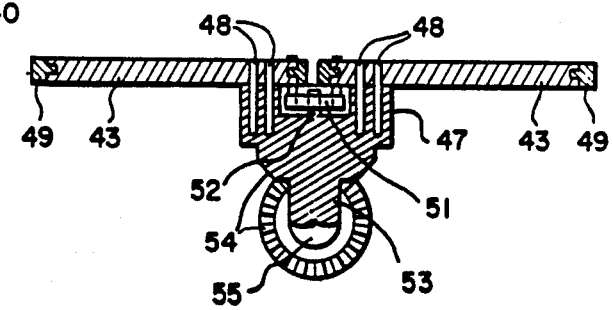

Blades 43 are each preferably constructed as shown in FIGS. 14 and 15 for purposes of convenient sealing as they traverse their respective cavities 44 in rotor 45. Each is made of two circular, bias-edged sections 46 arranged flatwise edge-to-edge and joined by an underlying, intermediate, circular section 47 which is securely fastened in place, as by press-fit pins 48, after installation of closely encircling sealing rings 49, that are similar to piston rings but are preferably of spring steel, by fastening opposite ends thereof to the respective sections 46, as by pivot pins 50. The opposite ends of such sealing rings are pivotally interconnected by a resilient strip 51, FIG. 14, usually of spring steel, pivoted centrally as indicated at 52.

The blade, as so made, is fixedly mounted on a stub shaft 53 provided with a bevel gear for intermeshing with the corresponding bevel gear of a gearing interconnection 54 with power takeoff shaft 55 as previously described for the power input shaft 20 of the air compressor.

Compression of the fuel mixture (or air for the diesel mode) takes place at one side of the mechanism (the other side handles exhaust) as in the compressing strokes of the previously described air compressor. The compressed charge is transferred to the combustion chamber 37 near the end of the compression stroke through a port 56, FIGS. 11 and 12, and passage 57, exhaust port 58 at the same side of the mechanism, but at the reverse side of the blade, being closed by the internal surface of the rotor. After transfer, combustion chamber intake port 56 is also closed by the internal surface of the rotor. Thereupon, the compressed fuel mixture in the combustion chamber is ignited, and, at the same time, exhaust port 58 is opened so that the burning gases expand into the rotor cavity 44 coming from the other side, the mechanism being driven thereby and a compression cycle commencing in such rotor cavity at the other face of the blade. At the same time, at the other side of cylindrical blade support 38, scavenging of the burned gases commences, such burned gases being pushed out of internal exhaust port 59, FIGS. 11 and 13, passage 60, and exterior exhaust port 61 at the exposed end of such blade support 38 as the corresponding blade end 46 of the blade 43 at that side of blade support 38 advances in the corresponding rotor cavity 44. Behind such advancing blade end 46, intake of a charge of fuel mixture (or air in the diesel mode) is taking place through port 40, passage 41, and port 42.

Figure 12:
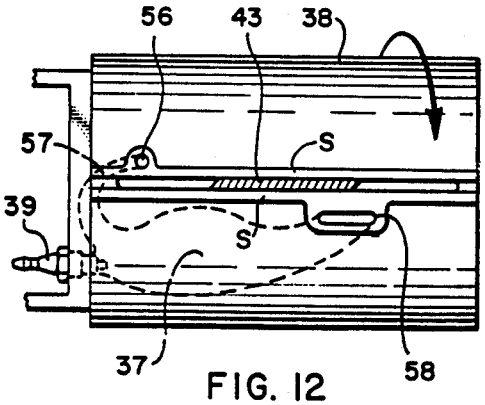
Figure 13:
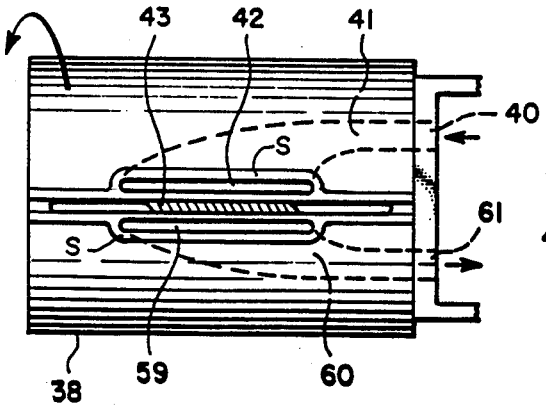

Longitudinal sealing strips S, FIGS. 12 and 13, are provided over and along ports 56 and 58, along ports 42 and 59, and along ports 19 and 29, FIG. 9, of the compressor.

As a pump, the mechanism is as illustrated in FIGS. 1–9, except that the air-intake ports 29, FIG. 9, become the liquid intake ports and the discharge ports 19 must be elongated and relocated centrally to conform to ports 29 so the ports of both of these sets of ports will always be in communication with their corresponding rotor cavities during the respective cycles of operation. This does not mean that the discharge ports must be the same size as the intake ports, since volumetric discharge equal to volumetric intake can be achieved with unequal sizes by adjusting power input. This is desirable, since it provides the advantages of a positive displacement pump by a rotary mechanism.

In the embodiment of FIGS. 9 and 10, it is only necessary to replace the discharge ports 19, passages 32, and discharge ports 33, with correponding ports and passages at the opposite ends of the rotor cavities.

In both embodiments, however, manifolds (similar to the piping 33, FIG. 1) should be provided interconnecting the intake ports and the discharge ports, respectively, so there will be a single intake and a single output for the pump.

Hydraulic and air motors are constructed and function similarly to pumps.

Figure 16:
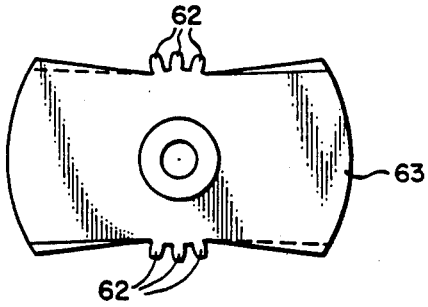
Figure 17:
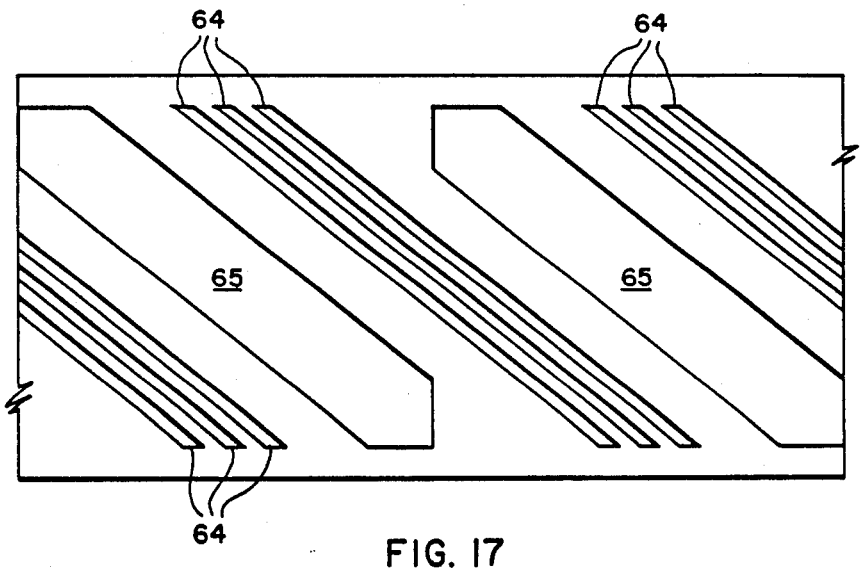

In all embodiments, except the internal combustion engine, it is possible to replace the gearing as rotation synchronizing means by the provision of blades in the form of rimless, multi-spoked wheels and corresponding multi-cavities in accordance with the commercial "single screw" air compressor previously mentioned herein. It is also possible to do the same by providing teeth projecting from opposite longitudinal sides of the blades, intermediate the lengths thereof, and with auxiliary rotor cavities corresponding therewith so as to obtain continuity of blade rotary motion similarly to that obtained by the multi-spoked, rimless wheels previously mentioned. Thus, as illustrated in FIG. 16, sets of teeth 62 may be provided at opposite longitudinal sides of blades 63 and, as illustrated by the layout of FIG. 17, sets of auxiliary cavities 64 for receiving such teeth may be provided on the inner cylindrical face of the rotor between the blade-receiving cavities 65.

For the internal combustion engine, a turbo compressor of conventional type can be provided by adding turbo blades directly to and around the outer periphery of the rotor and sending the air so-pressurized to the carburetor or fuel injector in conventional manner. Such air can also be used to cool the rotor and the sealant oil as will be apparent to those skilled in the art.

Figure 18:
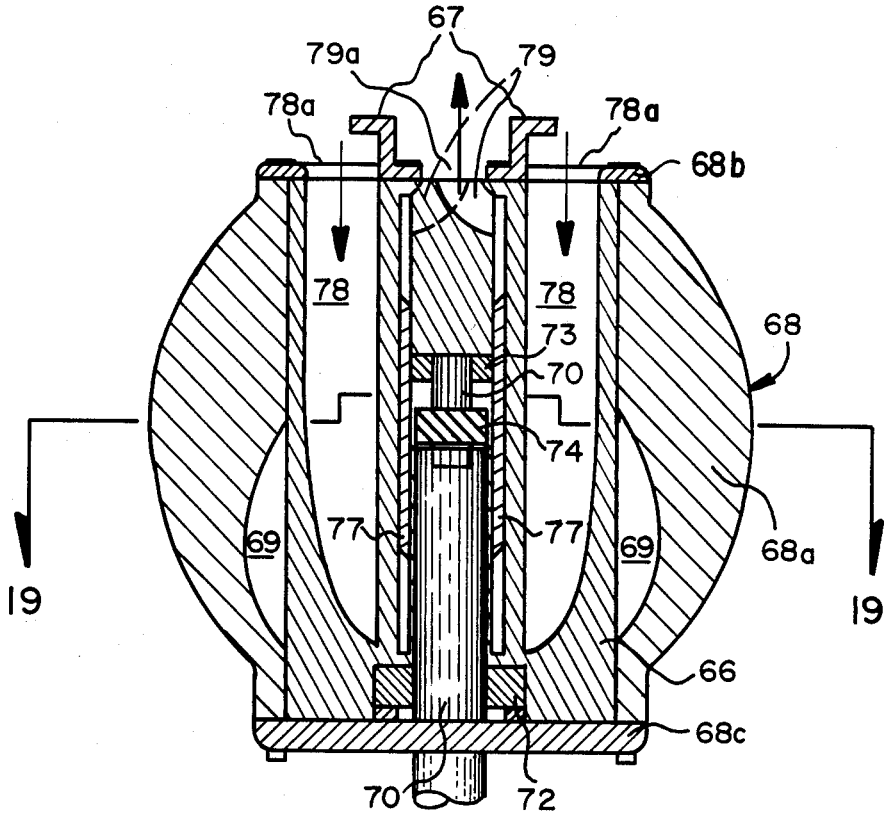
Figure 19:
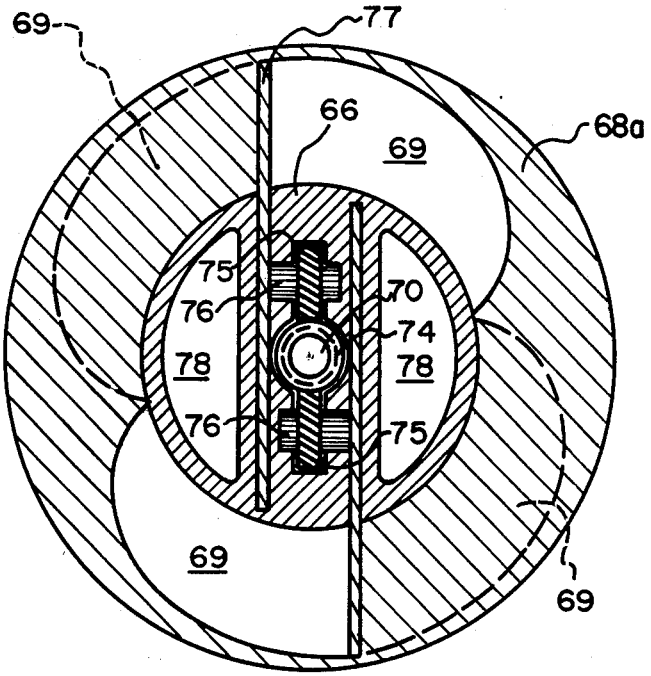

The embodiment of FIGS. 18 and 19 is a simplified version of the air compressor of FIGS. 1–9, and is now preferred as being the best mode presently contemplated for constructing such air compressor, as well a other forms of the invention, e.g. pumps and motors.

In the simplified embodiment, a cylindrical blade support 66 is firmly mounted as the stationary part of the device, as by means of a wall bracket 67, and rotatably carries a rotor 68, which is here shown as having a body **68*a* of generally spherical configuration to effectively accommodate dual cavities 69, respectively, opening into its interior cylindrical surface, which is interfaced with the cylindrical surface of blade support 66. A ring 68*b* at the mounting end of blade support 66 and a plate 68*c* at the opposite end thereof, with shaft corresponding to 20, secure the rotor on the blade support, much as in the embodiment of FIGS. 1 and 2**.

A shaft 70 extends centrally of blade support 66, from rigid securement to rotor plate 68*c*, and is journaled by bearings 72 and 73. It fixedly carries a gear 74 that meshes with respective gears 75, FIG. 19, which are fixedly mounted on respective stub shafts 76 of respective blades 77. Thus, rotary motion of rotor 68 is transmitted to the respective blades by a single shaft. Moreover, this arrangement most effectively accommodates respective air inflow passages 78, which diametrically flank shaft 70 and extend from respective inflow ports at the exposed end of stationary cylinder 66 almost to the opposite end thereof, and respective compressed air outflow passages 79.

Figure 20:
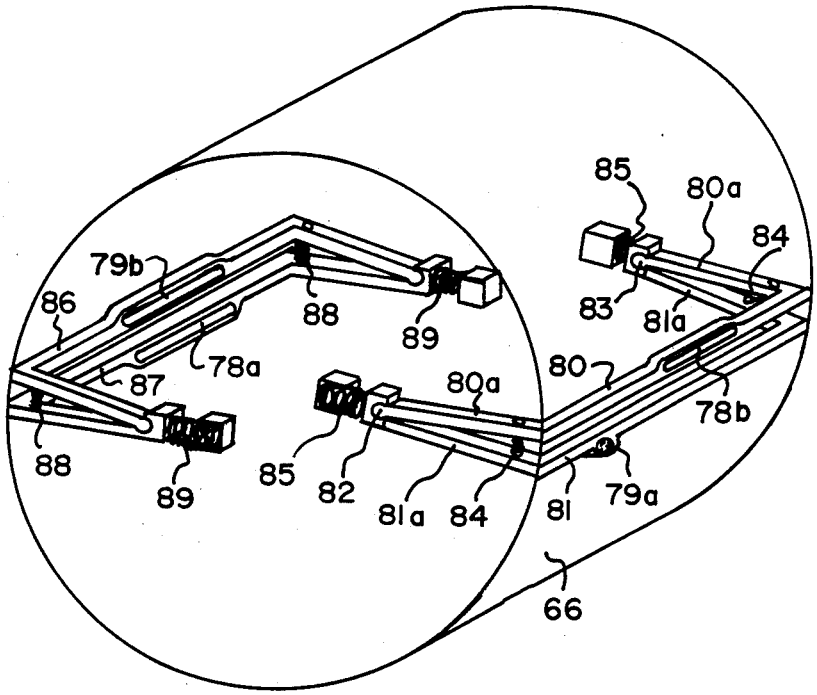

In instances in which the provision of sealings rings for the rotor is necessary, as when the mechanism is constructed as a motor, the system illustrated in FIG. 20 may be employed. As there shown in conjunction with the peripheral outline of cylindrical blade support 66, longitudinal sealing strips 80 and 81, extending along one side of the rotor from end-to-end thereof and having respective set of arms 80*a* and 81*a* extending inwardly of such support from opposite ends thereof, are hinged together at 82 and 83, respectively. Springs 84 between the arms at opposite ends, respectively, of the strips urge such strips toward each other so as to press them against the corresponding blade 77. Springs 85 at the hinged ends, respectively, of the arms press sealing strips 80 and 81 against the cylindrical interior surface of rotor 68 as such rotor rotates. A set of similar sealing strips 86 and 87, respectively, at the opposite side of blade support 66 are similarly mounted and are similarly pressed by respective springs 88 and by respective springs 89 against the corresponding blade 77 and against the cylindrical interior surface of rotor 68, respectively. The fluid to be compressed enters the compression chambers in rotor 68 through opening 78*a*, and compressed air discharges from such compression chambers through opening 79*a*. As a motor in the form of an internal combustion engine, the combustion gases enter the expansion chambers in rotor 68 through opening 78*b* and the exhaust gases discharge through opening 79*b*.

Figure 22:
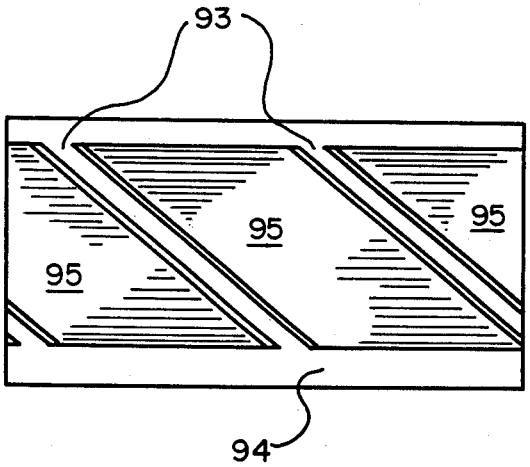
Figure 21:
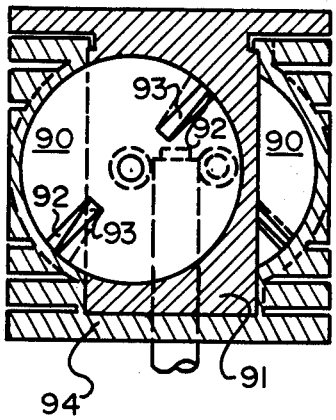

The embodiment of FIGS. 21 and 22 is also presently preferred and presented herein as a best mode presently contemplated for maximum volumetric handling of the fluids concerned. Instead of elongate blades, as 77 in FIGS. 18 and 19, the blades 90, here, in cylindrical blade support 91 are of circular configuration with diametrically oppposite, radial slots 92, respectively, into which fit helical walls 93, respectively, of rotor 94, which separate cavities 95 of such rotor. Drive mechanism for rotor 94 and air inlets and outlets are essentially the same as in the embodiment of FIGS. 18 and 19.

Figure 11:
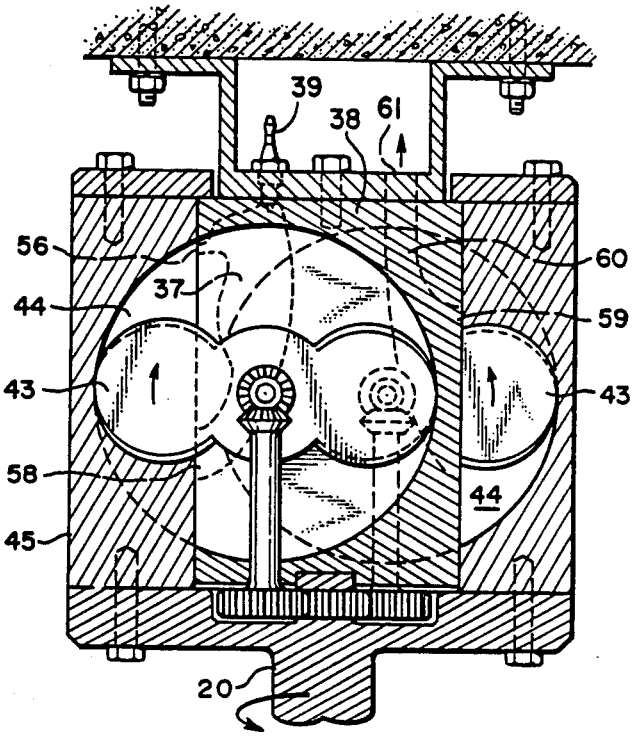
Figure 23:
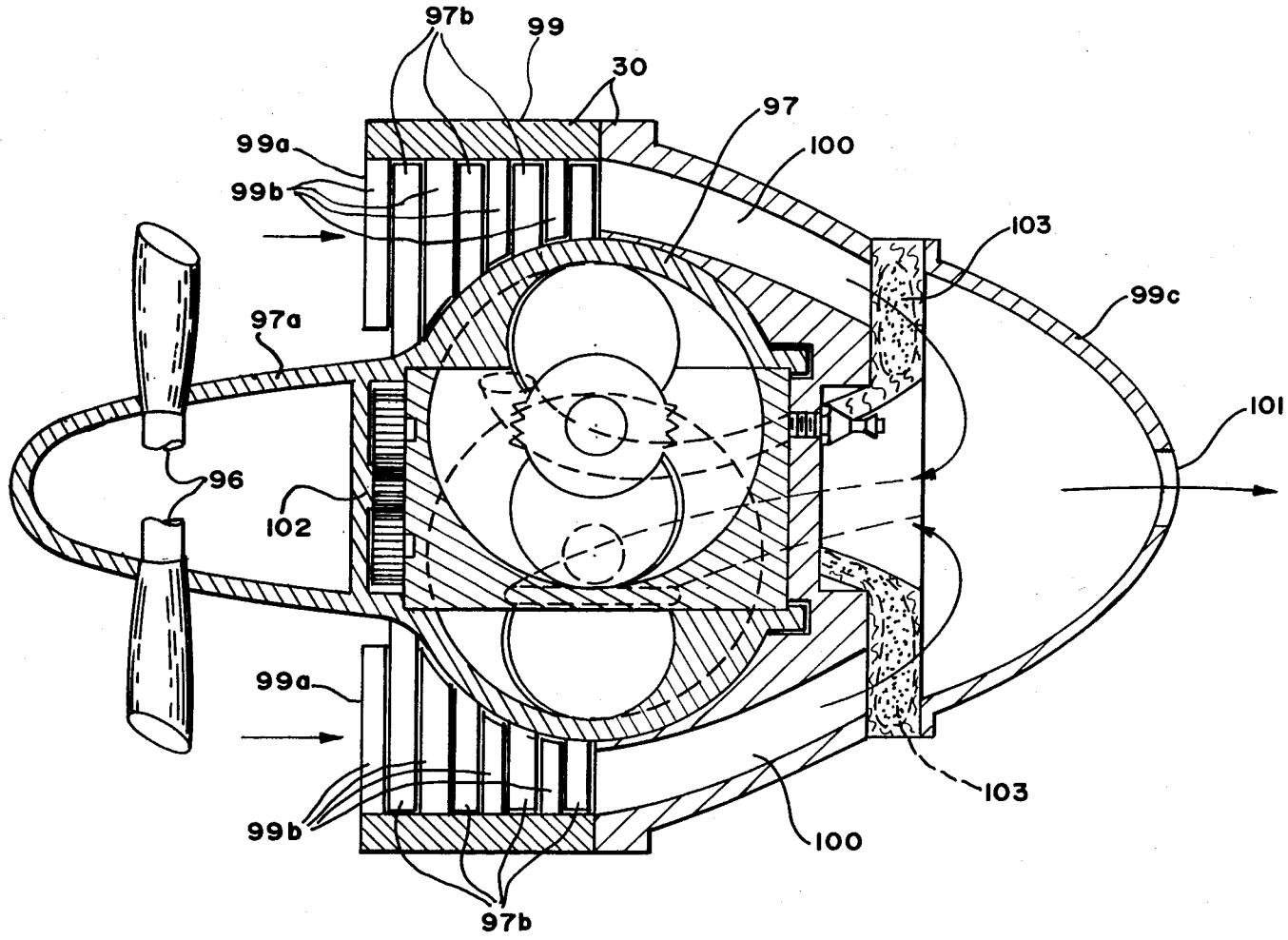
Figure 27:
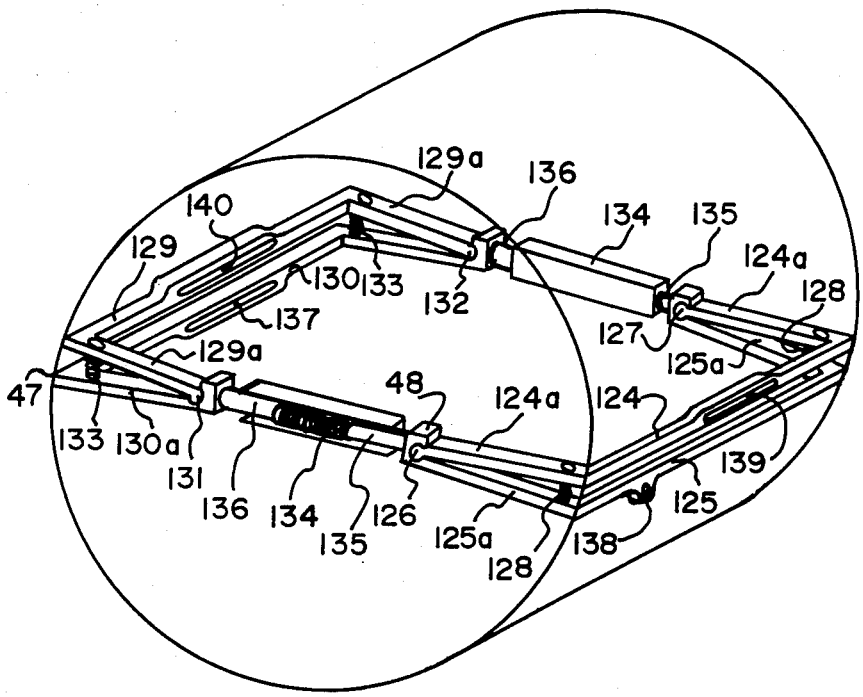

The embodiment of FIG. 23 is an internal combustion engine similar to that of FIG. 11 but having synchronizing teeth as in FIG. 16 and shown here as an airplane engine for driving propellers 96, which are mounted in a nose portion 97*a* of rotor 97, such nose portion constituting power transfer means provided by the rotor. Air is drawn in through the open front 99*a* of housing 99, which is adapted for attachment to the frame of an airplane, and is precompressed by compressor blades 97*b* affixed to rotor 97 and movable between stationary blades 99*b* affixed to housing 99. The precompressed air moves through passages 100 to a conventional fuel mixture system (not shown) in rear housing portion 99*c*. Exhaust gases are vented through opening 101 in housing portion 99*c*. A system for circulating and cooling lubricating oil (not shown) may include the drive gearing 102, acting as a pump, and radiator coils 103. A sealing ring system similar to that of FIG. 20 may be employed in this internal combustion motor. It is illustrated in FIG. 27 and described hereinafter.

Figure 24:
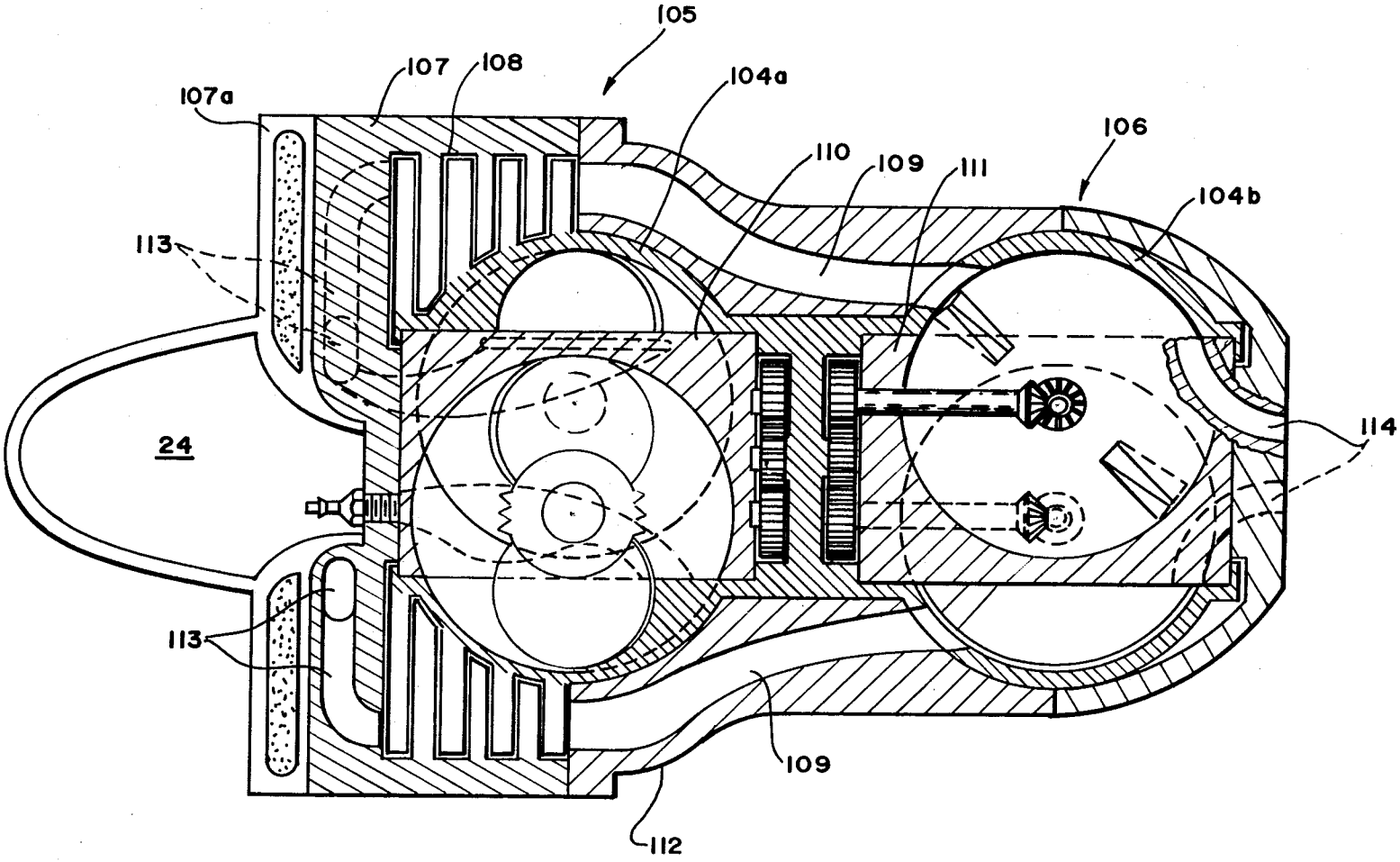

In FIG. 24, essentially the same internal combustion engine illustrated in FIG. 23 is shown coupled to an air compressor having circulat blades similar to those of FIG. 21 and 22. In this instance, the respective rotors 104*a* and 104*b* of engine 105 and compressor 106 are joined together as a single unit driven by the engine rotor 104*b* constituting the power transfer means of rotor 104*a*. Air is drawn into the engine through openings (not shown) in the front wall 107*a* of engine housing 107 and flows through precompressor 108 and passages 109 to compressor 106. Cylindrical blade supports 110 and 111 are rigidly fastened to housing 112, as by means of bolts (not shown), and the housing is secured to the frame of an airplane, where the device is used for jet propulsion, or to any suitable stationary mounting where used as an industrial air compressor. Engine exhaust may be directed through passages 113 for compression along with the air drawn in. Compressed air exits through respective passages 114.

Figure 25:
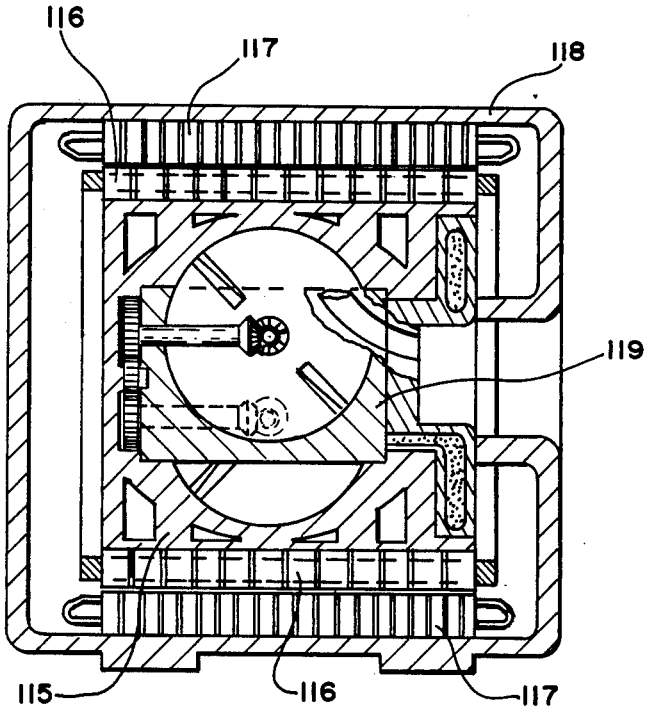

In FIG. 25 is shown an air compressor corresponding in its essentials to that of FIG. 24, but incorporated in an electric motor of squirrel cage induction type, which serves as the drive means. Rotor 115 of the compressor unit carries a secondary, squirrel cage winding 116 and also serves as the rotor of the motor. Primary winding 117 is affixed to and carried by stationary housing 118 constituting the stator of the motor. Housing 118 also carries in fixed relationship therewith cylindrical blade holder 119. Electrical connections (not shown) for primary winding 117 to an alternating current power source are conventional.

Figure 26:
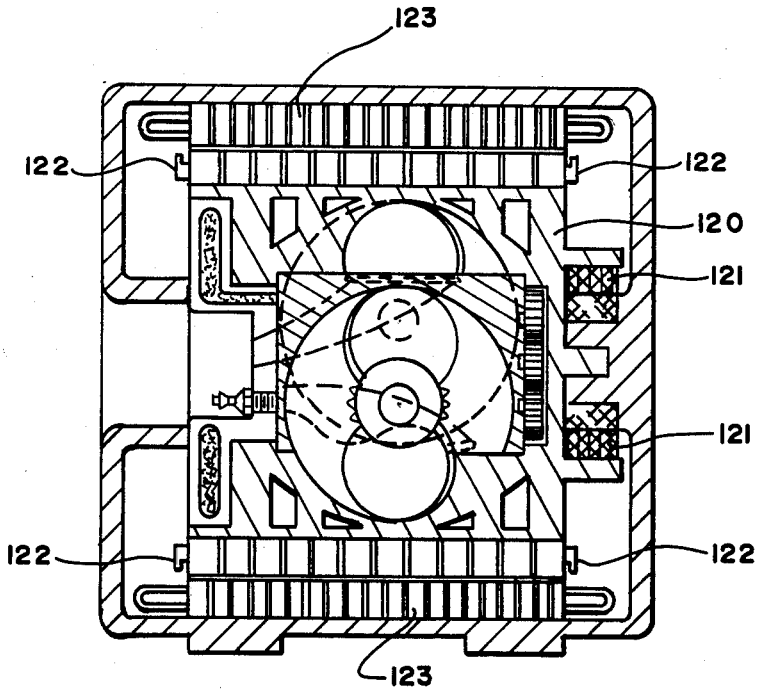

In FIG. 26 is shown an internal combustion engine corresponding in its essentials to the combustion engine of FIG. 24, but incorporated in an electric generator of construction similar to that of the squirrel cage motor of FIG. 25. As rotor 120 or the engine rotates, brushless, direct-current exciter 121 feeds current to rotor poles 122, thereby inducing voltage on stator windings 123. Again, electrical connections (not shown) are conventional. This embodiment is especially useful as an electrical source unit for electric tractor wheels of vehicles and for ship propellors.

In both the embodiments of FIGS. 25 and 26, the windings 116 and 122 constitute power transfer means provided on the rotor.

Sealing is effected in the engines of the foregoing embodiments in a manner essentially similar to that shown in FIG. 20. Thus, as shown in FIG. 27, a set of longitudinal sealing strips 124 and 125 at one side of the cylindrical blade support and having arms 124*a* and 125*a*, respectively, are hinged at 126 and 127, respectively. Springs 128 correspond to springs 84. At the opposite side of the blade support, a second set of longitudinal sealing strips 129 and 130, having arms 129*a* and 130, are similarly hinged at 131 and 132 respectively. Springs 133 correspond to springs 88. Here, however, the sets of arms 124*a* and 124*a* and 129*a* and 130*a*, respectively, are urged apart by respective springs 134 acting on arm extensions 135 and 136, rather than by the respective sets of separate springs 85 and 89. Air for fuel mixture enters the corresponding compression chambers of the engine rotor through opening 137, compressed fuel mixture air enters the combustion chamber of the engine through opening 138, expansion gases from the combustion chamber enter the corresponding rotor cavity through opening 139, and exhaust gases pass out through opening 140.

Figure 28:
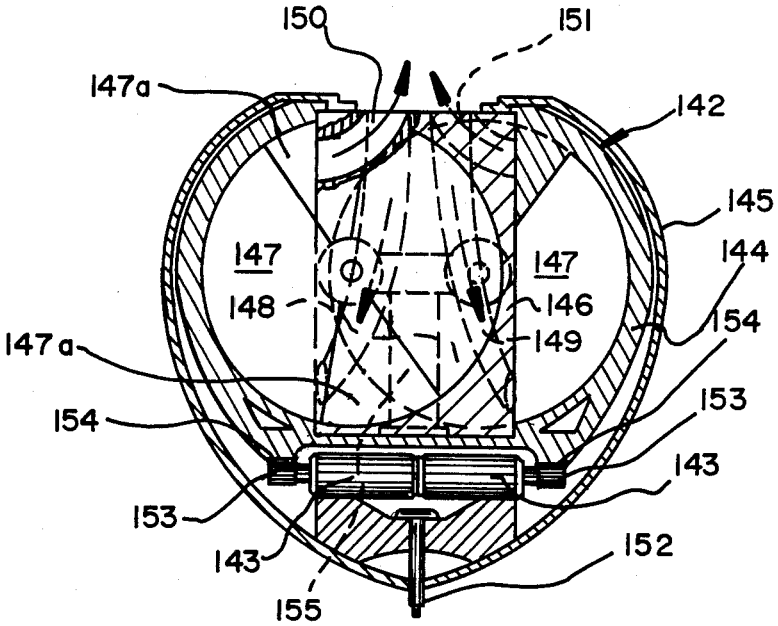

In FIG. 28, the mechanism is shown as the pump unit 142 of an artificial heart in construction similar to the unit shown in FIGS. 18 and 19 and driven by both or by one or the other of respective, side-by-side mounted, direct current motors 143. Rotor 144 of pump unit 142 is of generally spherical formation, as is the rotor of FIGS. 18 and 19, and is fitted within a conveniently heart-shaped housing 145, which is adapted to be suitably anchored in the body of a recipient human or animal. Cylindrical blade support 146 is affixed to housing 145 and rotatably carries circular blades 147, respectively, which are driven in synchronism with rotor 144 by geared interconnection as in FIGS. 18 and 19. Blood enters pump unit 142 through inlet passages 148 and 149, corresponding, respectively, to the cava vein and the pulmonary vein to which they are to be connected, and is pumped out through outlets 150 and 151, corresponding, respectively, to the aorta artery and the pulmonary artery to which they are to be connected. The design of blades 147 is such as to reproduce the natural pumping cycle of the heart which is replaced, e.g. the pumping cycle of the human heart wherein, in each cycle, a pause of one fourth of the cycle occurs. Electric cable 152 powers both motors by connection to an electrical battery carried externally of the body, and each of the motors drives rotor 144 by a respective pinion 153 meshing with a ring gear formation 154 of rotor 144. Each motor 143 is itself capable of driving rotor 144. The two are provided so that there is always a spare if one fails to operate effectively. Shaft 155 drives the synchronizing gears.

As illustrated, the artificial heart is substantially actual size for pumping five liters of blood per minute at approximately thirty-five revolutions of the rotor per minute. If used as an assist for a natural heart, size and pumping capacity will be reduced accordingly.

Whereas this invention is here illustrated and described with specific reference to embodiments thereof presently contemplated as the best modes of carrying out such invention in actual practice, it is to be understood that various changes may be made in adapting the invention to different embodiments without departing from the broader inventive concepts disclosed herein and comprehended by the claims that follow.

I claim:

1. Rotary fluid-handling mechanism constructed as an internal combustion engine, comprising a rotor cylindrically recessed internally from one end thereof and provided with power transfer means; a stationary cylinder closely and sealingly fitted within the rotor recess; means for fixedly mounting said cylinder relative to said rotor; means holding said rotor on said cylinder; at least one pair of oppositely disposed, helically oriented cavities in the rotor, opening at the interior cylindrical surface thereof in confronting relationship with the cylindrical surface of said stationary cylinder; at least one corresponding pair of blades independently rotatably mounted within and at diametrically opposite sides of said stationary cylinder on respective axes at right angles to the axis of rotation of said rotor, so portions thereof will enter and pass through the respective cavities during synchronized rotation of said blades and said rotor; means for synchronizing rotation of said blades and said rotor; means for providing inflow of fluid internally of said mechanism into the paths of advancing movement of said blades within said cavities; means for the discharge from the mechanism of fluid acted upon by said blades; a combustion chamber formed within the stationary cylinder and having an inflow port and an outflow port; sealing means provided about the respective blade edges that contact rotor cavity surfaces; means for igniting a gaseous fuel mixture within said combustion chamber; the fluid inflow means comprising an exterior inflow port and an inflow passage leading therefrom to an interior inflow port at one longitudinal side of the stationary cylinder for introducing a gaseous fuel mixture or air in advance of travel of the blade in a rotor cavity as such cavity passes said interior inflow port; a smaller port at the opposite longitudinal side of said stationary cylinder and leading into said combustion chamber for transferring compressed gaseous fuel mixture or air into said combustion chamber from a rotor cavity as such cavity passes said smaller port; an outlet port in said combustion chamber at said opposite longitudinal side of said stationary cylinder for transferring exploding fuel mixture from said combustion chamber to a rotor cavity as such cavity passes said outlet port; and the means for discharging fluid including an interior exhaust port at said one longitudinal side of the stationary cylinder and a passage leading therefrom to an exterior exhaust port, so expanded gas from rotor cavities that pass said interior exhaust port will exhaust to atmosphere.

2. Mechanism according to claim 1, wherein the blades are of elongate configuration and are rotatably mounted, one above the other, in respective chambers opening oppositely into the cylindrical face of the stationary cylinder.

3. Mechanism according to claim 1, wherein the means for providing inflow of fluid and the means for the discharge of fluid comprise respective port means opening into the cylindrical face of the stationary cylinder; and wherein there are provided sealing strips extending longitudinally of said cylinder substantially from end-to-end thereof at opposite sides of each of said port means.

4. Mechanism according to claim 1, wherein the means for synchronizing rotation of blades and rotor comprise intermeshed gearing between the rotor and the blades internally of the rotor and the stationary cylinder.

5. Mechanism in accordance with claim 1, wherein the blades are each made up of two circular sections fastened together in edge-to-edge flatwise formation by a third intermediate section, and the sealing rings are split resilient rings pivotally fastened at one set of ends to said circular sections, the other set of ends being pivotally interconnected by an elongate member pivoted to said other set of ends and pivoted intermediate its length to said intermediate section.

6. Mechanism in accordance with claim 1, wherein the inflowing fluid is a gaseous fuel mixture, and the igniting means is a spark plug associated with the combustion chamber.

7. Mechanism in accordance with claim 1, wherein the inflowing fluid is air and the ignition means is a fuel injector for the combustion chamber so the mechanism operates as a diesel engine.

8. Mechanism according to claim 1, wherein the blades are elongate and the synchronizing means comprise sets of teeth projecting from opposite longitudinal edges, respectively, of the blades intermediate the lengths thereof, and there are corresponding sets of auxiliary cavities at opposite sides of the internal cylindrical surface of the rotor for receiving the respective teeth during operation of the mechanism.

9. Mechanism according to claim 3, wherein the sealing strips include sets of longitudinal strips carried by the stationary cylinder, each set being provided with resilient means for forcing the strips thereof against opposite faces of the corresponding blade and with resilient means for forcing the strips thereof against the opposing face of the rotor.

10. Mechanism according to claim 1, wherein the blades are of circular configuration having diametrically opposed radial slots; and wherein the cavities of the rotor are separated by helical walls which fit into said slots.

11. Mechanism according to claim 1, wherein the internal combustion engine is mounted in a housing to which the stationary cylinder is affixed; and wherein power takeoff means are connected to the rotor of said engine.

12. Mechanism according to claim 11 wherein the rotor carries secondary windings of an electrical machine and the housing carries primary windings of said machine, so that the mechanism will function as an internal combustion engine driving an electric generator.

13. Mechanism according to claim 11, wherein the power takeoff means comprise a protruding nose portion of the engine rotor and propeller blades affixed to said nose portion, the housing being adapted for mounting in a vehicle such as an airplane.

14. Mechanism according to claim 11, wherein the power takeoff means comprises an air compressor having a compressing rotor coupled to the engine rotor, said compressor having a compressed air outlet adapted to supply motivating force.

15. Mechanism according to claim 13, wherein the housing is open about the protruding nose portion of the engine rotor, and there are compressor blades affixed to the rotor and cooperative stationary blades affixed to the housing behind the said opening thereof for compressing air used in the operation of the engine.

16. Rotary fluid-handling mechanism constructed as an internal combustion engine, comprising a rotor cylindrically recessed internally from one end thereof and provided with power transfer means; a stationary cylinder closely and sealingly fitted within the rotor recess; means for fixedly mounting said cylinder relative to said rotor; means holding said rotor on said cylinder; at least one pair of oppositely disposed, helically oriented cavities in the rotor, opening at the interior cylindrical surface thereof in confronting relationship with the cylindrical surface of said stationary cylinder; at least one corresponding pair of blades independently rotatably mounted within and at diametrically opposite sides of said stationary cylinder on respective axes at right angles to the axis of rotation of said rotor, so portions thereof will enter and pass through the respective cavities during synchronized rotation of said blades and said rotor; means for synchronizing rotation of said blades and said rotor; sealing means provided about the respective blade edges that contact rotor cavity surfaces; a combustion chamber formed within the stationary cylinder; means for igniting a gaseous fuel mixture within said combustion chamber; means at one side of the mechanism for providing inflow of a gaseous fuel mixture or air internally of said mechanism into the paths of advancing movement of said blades within said cavities; means at the opposite side of the mechanism for transferring compressed gaseous fuel mixture or air from rotor cavities to the combustion chamber; means at said one side of the mechanism, but at the reverse sides of the blades, for discharging exhaust fluid from the combustion chamber into the rotor cavities for motivating the rotor; and means at said one side of the mechanism for exhausting combustion gases from the mechanism.

* * * * *

UNITED STATES PATENT AND TRADEMARK OFFICE

CERTIFICATE OF CORRECTION

PATENT NO. : 4,620,515

DATED : November 4, 1986

INVENTOR(S) : Alvaro Marin A.

It is certified that error appears in the above-identified patent and that said Letters Patent is hereby corrected as shown below:

Column 1, line 58, a closing parenthesis should be inserted after "volume".

Column 8, line 10, the word "circulat" is incorrect and should be "circular".

Signed and Sealed this

Twentieth Day of January, 1987

*Attest:*

DONALD J. QUIGG

*Attesting Officer*

*Commissioner of Patents and Trademarks*